US011846152B2

(12) United States Patent
Smith

(10) Patent No.: US 11,846,152 B2
(45) Date of Patent: Dec. 19, 2023

(54) MECHANICAL JAR, METHOD AND SYSTEM

(71) Applicant: James Smith, Manvel, TX (US)

(72) Inventor: James Smith, Manvel, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/412,629

(22) Filed: Aug. 26, 2021

(65) Prior Publication Data

US 2023/0064658 A1 Mar. 2, 2023

(51) Int. Cl.

| | |
|---|---|
| ***E21B 31/107*** | (2006.01) |
| ***E21B 23/08*** | (2006.01) |
| ***E21B 23/00*** | (2006.01) |
| ***E21B 31/113*** | (2006.01) |

(52) U.S. Cl.

CPC ..... *E21B 31/107* (2013.01); *E21B 23/006* (2013.01); *E21B 23/08* (2013.01); *E21B 31/113* (2013.01)

(58) Field of Classification Search

CPC ..... E21B 23/08; E21B 23/006; E21B 31/107; E21B 31/1075; E21B 31/113; E21B 31/1135

See application file for complete search history.

(56) References Cited

U.S. PATENT DOCUMENTS

| | | | | |
|---|---|---|---|---|
| 5,232,060 | A * | 8/1993 | Evans | E21B 17/07 166/178 |
| 5,624,001 | A * | 4/1997 | Evans | E21B 31/113 166/178 |
| 2006/0085432 | A1 | 3/2006 | Rose | |
| 2011/0083851 | A1 | 4/2011 | Evans | |
| 2011/0108285 | A1* | 5/2011 | Fagley, IV | E21B 23/04 166/117.6 |
| 2011/0297380 | A1* | 12/2011 | Alberty | E21B 31/113 166/301 |

FOREIGN PATENT DOCUMENTS

| | | | |
|---|---|---|---|
| EP | 0380263 | A2 | 8/1990 |
| WO | 2014168623 | A1 | 10/2014 |
| WO | 2020146143 | A1 | 7/2020 |

OTHER PUBLICATIONS

Notification of Transmittal of the International Search Report and The Written Opinion; PCT/US2022/07523; dated Dec. 6, 2022; 9 pages.

* cited by examiner

*Primary Examiner* — Nicole Coy
*Assistant Examiner* — Nicholas D Wlodarski
(74) *Attorney, Agent, or Firm* — CANTOR COLBURN LLP

(57) ABSTRACT

A mechanical jar including a housing, a piston disposed in the housing and responsive to applied fluid pressure to move in a first direction relative to the housing, a biasing arrangement disposed in the housing and configured to bias the piston in a second direction opposite the first direction, and a restraint configured to prevent movement of the piston in the second direction until a threshold force is applied to the restraint by the piston, whereafter the piston suddenly moves in the second direction.

10 Claims, 3 Drawing Sheets

MECHANICAL JAR, METHOD AND SYSTEM

BACKGROUND

In the resource recovery and fluid sequestration industries, tools sometimes become stuck. "Jars" are known as a concept and employ various complicated mechanical means or energetic material means, for example, to generate the "jar" near a stuck component in the hopes that the stuck component will free up. While various known mechanisms work for the purpose, there are many distinct situations and conditions that generate the need for a jar and there are not always devices known that can be used in such situations. Accordingly, the art will well receive additional alternative jar mechanisms to provide a broader range of utilities.

SUMMARY

An embodiment of a mechanical jar including a housing, a piston disposed in the housing and responsive to applied fluid pressure to move in a first direction relative to the housing, a biasing arrangement disposed in the housing and configured to bias the piston in a second direction opposite the first direction, and a restraint configured to prevent movement of the piston in the second direction until a threshold force is applied to the restraint by the piston, whereafter the piston suddenly moves in the second direction.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
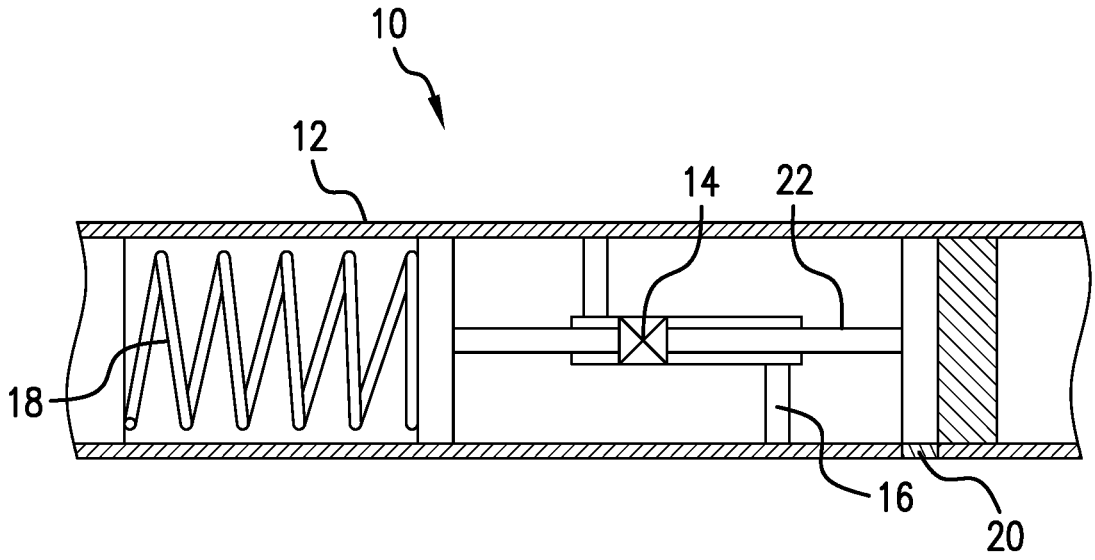
FIG. 1 is a section view of a jar in a resting position as disclosed herein.

Referring to FIG. 1, a mechanical jar 10 is illustrated in a resting position. The jar 10 includes a housing 12, within which is disposed a movable piston 14. The piston 14 is movable based upon application of fluid pressure through a port 16 and also movable based upon force provided by a biasing arrangement 18. The piston 14 may be cycled back and forth by applying fluid pressure to the port 16, which compresses the biasing arrangement 18 to some degree and then by reducing the applied pressure to the port 16 to allow the biasing arrangement 18 to force the piston 14 back to its resting position (or beyond under circumstances discussed below). Application of fluid pressure and reduction thereof is an operating principle both for initial setting of the jar and for ultimate actuation of the jar. This will become clear below.

In an embodiment, an incrementing feature 20 is included. The incrementing feature is interactive with the jar to dictate a number of pressure events before the jar is settable. This allows for other anticipated well operations prior to actuation of the jar. In one variation, the incrementing feature is a J-slot. With an incrementing feature, a specific pattern of pressure events may be employed to "address" the jar 10 and allow it to move into a set position. Incrementing features operating in this way for other tools are known to the industry and therefore require no specific teaching.

Figure 2:
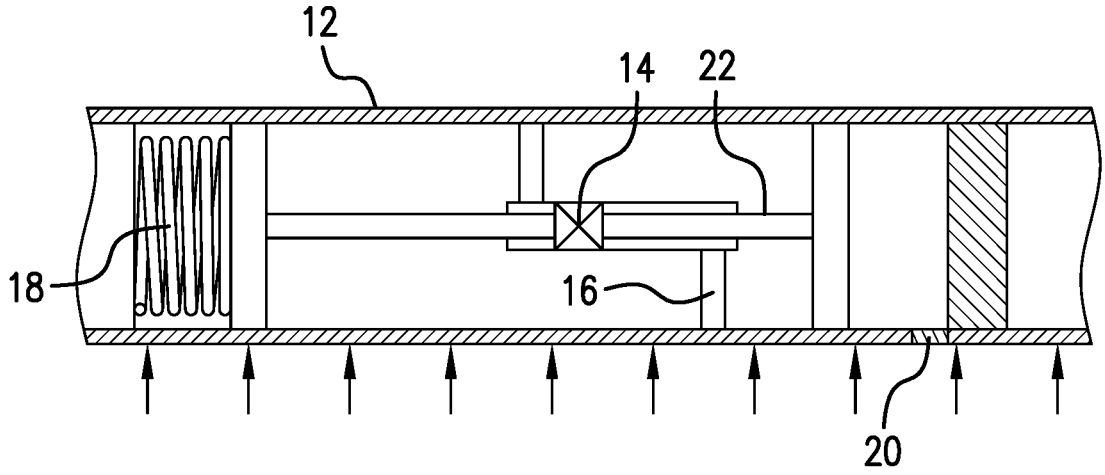
FIG. 2 is a section view of the same jar as illustrated in FIG. 1 but in a pressure activated position.
Figure 3:
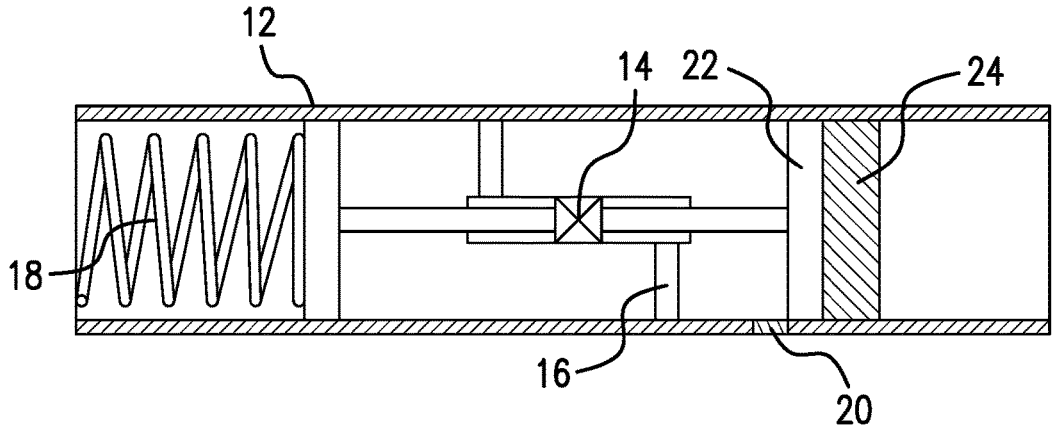
FIG. 3 is again the same jar but illustrated in a set position.
Figure 4:
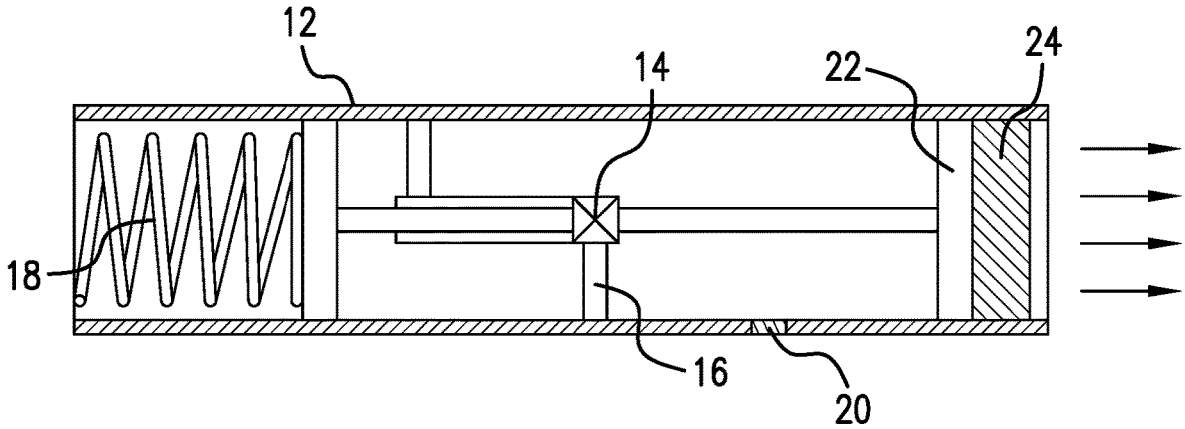
FIG. 4 is the same jar in a released position.

Referring to FIG. 2, pressure is being applied to the port 16. It is evident in the illustration that the piston 14 has moved to the left in the Figure compressing, to a degree, the biasing arrangement 18. It will also be appreciated that the piston 14 is connected to a connector 22 that interacts with the incrementing feature 20 and dictates when the piston 14 may be moved all the way to the left or all the way to the right of the figure. The force of the compressed biasing arrangement 18 is now available to force the piston 14 back toward the right of the figure when the applied pressure through port 16 is reduced. The sequence may need to occur several times prior to the incrementing feature allowing a full stroke of the piston 14 and thereby actuation of the jar depending upon how many increments and what type of incrementing the incrementing feature 20 dictates. Once the preselected increments have been reached, and the piston 14 is free to move through its full stroke, the force stored in the biasing arrangement 18 is applied to the piston and through the piston 14 to a restraint 24. The restraint 24 is configured to hold a portion of available force applied by the biasing arrangement 18 but not all of the force. This is illustrated in FIGS. 3 and 4. More specifically, it is to be understood that the restraint 24 is configured to release at a threshold amount of force that is lower than the total amount of force that can be applied by the biasing arrangement 18. Stated alternately, the jar 10 is always configured with greater force capability in the biasing arrangement 18 than restraining capability of the restraint 24. This can be accomplished through the use of shear members, collets, rupture member, etc. as the restraint 24. For example, the force available from biasing arrangement 18 may be 100 lbs and the restraint may be configured to release at 80 lbs. In such situation, force will build on the restraint until it reaches its release threshold and then the force would be suddenly released. It is the sudden release that provides the utility of the presently disclosed mechanical jar 10. The sudden release allows an operator to provide an impact force with one of the piston 14, connector 22, or a component attached thereto to a target component (not shown) that may be stuck. The jar herein is simple and reliable and if the restraint 24 is a resettable type such as a collet, then the jar may be used more than once without being tripped out of the borehole.

Figure 5:
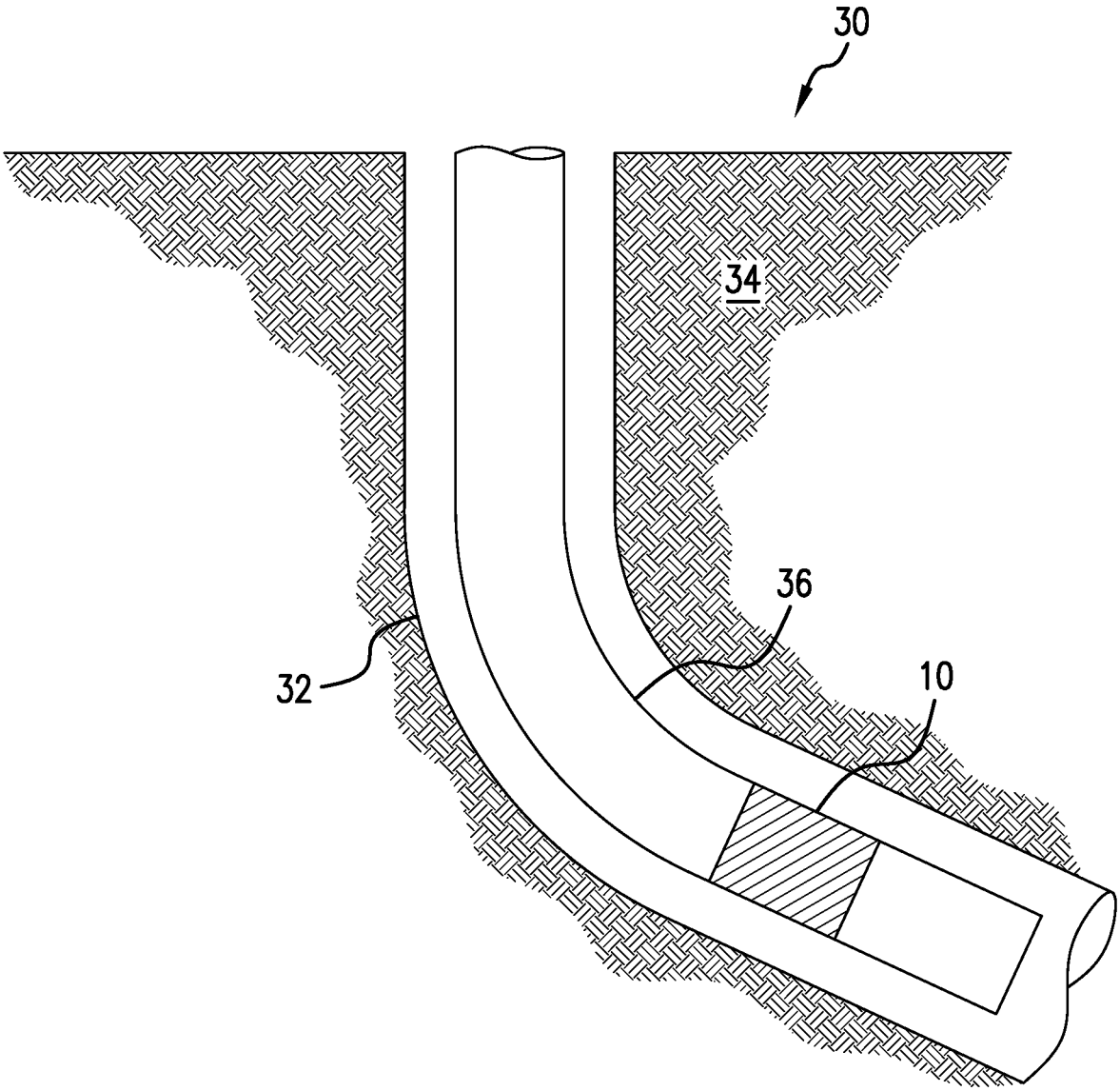
FIG. 5 is a view of a wellbore system including the jar disclosed herein.

Referring to FIG. 5, a wellbore system 30 is illustrated. The system 30 includes a borehole 32 in a subsurface formation 34. A string 36 is disposed in the borehole 32. A mechanical jar 10 is disposed within or as a part of the string 36.

Set forth below are some embodiments of the foregoing disclosure:

Embodiment 1: A mechanical jar including a housing, a piston disposed in the housing and responsive to applied fluid pressure to move in a first direction relative to the housing, a biasing arrangement disposed in the housing and configured to bias the piston in a second direction opposite the first direction, and a restraint configured to prevent movement of the piston in the second direction until a threshold force is applied to the restraint by the piston, whereafter the piston suddenly moves in the second direction.

Embodiment 2: The mechanical jar as in any prior embodiment further comprising an incrementing feature preventing movement of the piston in the first direction until a selected number of inputs is received by the incrementing feature.

Embodiment 3: The mechanical jar as in any prior embodiment, wherein the incrementing feature is a J-slot.

Embodiment 4: The mechanical jar as in any prior embodiment, wherein the inputs are pressure events.

Embodiment 5: The mechanical jar as in any prior embodiment, wherein the piston includes a connection member connected to the incrementing feature.

Embodiment 6: The mechanical jar as in any prior embodiment, wherein the biasing arrangement is a spring.

Embodiment 7: The mechanical jar as in any prior embodiment, wherein the restraint is a shear member.

Embodiment 8: The mechanical jar as in any prior embodiment, wherein the restraint is a rupture member.

Embodiment 9: The mechanical jar as in any prior embodiment, wherein the restraint is a collet.

Embodiment 10: A method for jarring a component downhole including running a mechanical jar as in any prior embodiment into proximity to a component to be jarred, pressuring up on the jar, applying biasing arrangement force through the piston to a restraint in the housing, causing release of the restraint, and suddenly releasing the biasing arrangement force.

Embodiment 11: The method as in any prior embodiment further including cycling pressure up events to cycle an incrementing feature associated with the mechanical jar.

Embodiment 12: The method as in any prior embodiment further including impacting a target using the suddenly released biasing arrangement force.

Embodiment 13: A wellbore system including a borehole in a subsurface formation, a string disposed in the borehole, a mechanical jar as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. Illustrative well operations include, but are not limited to drilling, hydraulic fracturing, stimulation, cleaning, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A mechanical jar comprising:

a housing;

a piston disposed in the housing and responsive to applied fluid pressure to move in a first direction relative to the housing;

a biasing arrangement disposed in the housing and configured to bias the piston in a second direction opposite the first direction;

a restraint configured to prevent movement of the piston in the second direction until a threshold force is applied to the restraint by the piston, whereafter the piston suddenly moves in the second direction; and further comprising a J-Slot incrementing feature preventing movement of the piston in the first direction until a plurality of pressure up events is received by the jar each pressure event causing movement of the incrementing feature.

2. The mechanical jar as claimed in claim 1, wherein the piston includes a connection member connected to the incrementing feature.

3. The mechanical jar as claimed in claim 1, wherein the biasing arrangement is a spring.

4. The mechanical jar as claimed in claim 1, wherein the restraint is a shear member.

5. The mechanical jar as claimed in claim 1, wherein the restraint is a rupture member.

6. The mechanical jar as claimed in claim 1, wherein the restraint is a collet.

7. A method for jarring a component downhole comprising:

running a mechanical jar as claimed in claim 1 into proximity to a component to be jarred;

pressuring up on the jar;

applying biasing arrangement force through the piston to a restraint in the housing;

causing release of the restraint; and suddenly releasing the biasing arrangement force.

8. The method as claimed in claim 7 further including cycling pressure up events to cycle an incrementing feature associated with the mechanical jar.

9. The method as claimed in claim 7 further including impacting a target using the suddenly released biasing arrangement force.

10. A wellbore system comprising:

a borehole in a subsurface formation;

a string disposed in the borehole;

a mechanical jar as claimed in claim 1 disposed within or as a part of the string.

* * * * *